US006335666B1

(12) United States Patent
Lemonnier et al.

(10) Patent No.: US 6,335,666 B1
(45) Date of Patent: Jan. 1, 2002

(54) HIGH FREQUENCY CIRCUIT WITH VARIABLE PHASE SHIFT

(75) Inventors: Jean-Pierre Lemonnier, St-Cyr l'Ecole; Maurice Bernaud, Asnières, both of (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 09/435,920

(22) Filed: Nov. 8, 1999

(Under 37 CFR 1.47)

(30) Foreign Application Priority Data

Nov. 9, 1998 (FR) ..... 98 14056

(51) Int. Cl.[7] ..... H01P 3/00

(52) U.S. Cl. ..... 333/164; 333/104; 333/140; 333/144

(58) Field of Search ..... 333/81 A, 81 R, 333/104, 262, 33, 140, 138, 156, 160, 161, 164, 144

(56) References Cited

U.S. PATENT DOCUMENTS 3,982,214 A 9/1976 Burns 5,208,564 A 5/1993 Burns et al.

5,521,560 A * 5/1996 Burns et al. ..... 333/81 A

* cited by examiner

*Primary Examiner*—Robert Pascal
*Assistant Examiner*—Kimberly E Glenn
(74) *Attorney, Agent, or Firm*—Sughrue, Mion, Zinn, Macpeak & Seas, PLLC

(57) ABSTRACT

To make a variable phase shifter at low cost and that is easy to manufacture, two propagation paths for a high frequency signal are provided in parallel between the input and the output of the phase shifter. These two paths are of different lengths. An intermediate node on one of the paths is connected to an intermediate node on the other path by a PIN diode. The diode is connected to the paths by a segment of line further enhancing the length difference. By biasing the diode to a desired level, it is caused to present a particular impedance to propagation. It is shown that by acting in this way the diode can vary the phase shift between the input and the output without needing to use harmful reactive components.

12 Claims, 1 Drawing Sheet

HIGH FREQUENCY CIRCUIT WITH VARIABLE PHASE SHIFT

The present invention relates to a high frequency circuit with variable phase shift, usable mainly in the field of decimetric waves. It can be used therein in particular together with a plurality of antenna elements to provide variable squint pointing by feeding each of the antennas with the same signal for transmission, and by controlling the phase shifter circuits associated with the antennas to take up a determined phase relating to the pointing to be achieved. Nevertheless, other applications are possible. The object of the invention is to use a signal of given phase at the output from a circuit to produce a signal of phase that is offset relative to said given phase. The principle of the invention is also applicable to the field of non-decimetric waves.

BACKGROUND OF THE INVENTION

In the field of phase shifters, phase shifting circuits are known, in particular those based on so-called PIN diodes. PIN diodes are constituted by juxtaposing a P layer and an N layer of semiconductor material on either side of a thin insulating layer. Because of the presence of the insulating layer, the minority carriers of the PN junction are slow. Compared with a very high frequency signal, such a diode, when properly biased, can thus behave like a circuit exhibiting pure resistance.

Some publications describe PIN diodes as constituting switch elements at microwave frequencies. Such an element makes it possible to provide on/off selection of one particular transmission access selected from two possible accesses. In other applications, such diodes make it possible to connect a segment of line for reflection purposes in parallel with a given line. Such applications in the form of two-state functions are tied to the fact that with such diodes, insertion losses and standing wave ratios (SWRs) at the accesses can be controlled and defined simultaneously only in the two switching states. Specifically, that type of circuit can be guaranteed to be reproducible and suitable for industrialization only providing it is not used at settings that are intermediate between those two states. Known methods do not make it possible to provide continuous and simultaneous control over phase, standing wave ratio, and insertion loss.

Various types of circuit based on multiple Varactor diodes or indeed based on multiple PIN diodes have been used to make variable-shift phase shifters. The problem presented by Varactor diodes is that the capacitance of such diodes varies with bias voltage. They also have the drawback, particularly in the 3 GHz range, that the voltages required for scanning significant variation of impedance need excursions of the order of 20 volts. Such excursions are quite difficult to implement, even with voltage multipliers using charge pumps. In addition, Varactor diodes give rise to variations in reactive impedance that are difficult to compensate, unless some other reactive impedance is also used.

As for PIN diodes, which have the advantage of proposing variation that is of a resistive type, they nevertheless need to be manufactured with great care in order to be usable beyond 3 GHz, because of the presence of parasitic capacitance. This parasitic capacitance gives rise to a limit on frequency since the diode is connected in series to convey the radio signal. In addition, the use of circuits having numerous PIN diodes implies making microwave frequency circuits that occupy a large area on a printed circuit board, which is bulky and more difficult to develop. In particular, specialized PIN diodes are diodes in ceramic packages that are mounted manually. Under such circumstances, these ceramic packages are not surface mount components (SMC) type packages that are suitable for being put into place automatically by insertion machines in mass-produced circuits. Furthermore, the connection tabs of such packages gives rise to inductances which, in combination with the parasitic capacitance of the diode, can make such a circuit very difficult to define.

With multiple Varactor or PIN diodes, expensive and complex solutions requiring 90° couplers or 3 dB couplers must therefore be used in order to maintain good matching of input and output impedances.

OBJECTS AND SUMMARY OF THE INVENTION

An object of the invention is to remedy those problems of expense and of adjustment in particular, by proposing a solution in which the diodes used are PIN diodes (having slow minority carriers) of conventional type, i.e. PIN diodes of the kind that are available in packages suitable for surface mounting using automatic machines.

One idea of the invention is to provide, between an inlet and an outlet of a phase shifter, a separation into two propagation paths of different lengths. In addition, at least one PIN diode, and in practice two PIN diodes in parallel, are interconnected at intermediate positions via their terminals to nodes of each of these paths. By biasing the diode and ensuring that it presents a given resistance, a bias circuit makes it possible for each of the two paths to transfer an impedance to the input that will be seen by the signal at the input. Consequently, the input signal will take one path rather than the other. Since the paths are of different lengths, the two resulting signals at the output are phase-shifted relative to each other. When they are combined, they give rise to a signal which is the result of adding them together, and which possess a phase that depends on the respective contributions of each of these two components. The more favored signal imposes its phase the more easily.

In practice, such a phase shifter can produce a phase shift of about 20°. That is entirely satisfactory for pointing the aiming direction of an antenna having a plurality of radiating elements onto an off-axis or "squint" direction. If a phase shift of greater than 20° is desired, then it suffices to cascade a plurality of phase shifters of the same type as the phase shifter of the invention.

It is shown below that compared with the state of the art, the circuit of the invention presents the advantage that the signal to be transmitted does not pass via the PIN diodes. As a result, the parasitic capacitances of the diodes does not complicate the operation of the circuit. In practice, the imaginary impedance components of the PIN diodes are compensated by matching circuits, by metallic connections of desired length. Such matching has the advantage of being effective over a very wide range of use. For example, in a given circuit operating at around 6.6 GHz, it is very easy to use the phase shifter between 6.2 GHz and 6.9 GHz, i.e. over a range of more than 10% of the center of frequency.

The invention thus provides a variable phase shift high frequency circuit comprising an input for a high frequency signal, two propagation paths for said signal each connected at one end to said input, a PIN diode having its terminals connected to first and second intermediate nodes on each of the two paths respectively, an output for the phase-shifted high frequency signal connected to the other ends of the two paths, and a circuit for biasing the diode.

BRIEF DESCRIPTION OF THE DRAWINGS

The invention will be better understood on reading the following description and on examining the accompanying figures. The figures are given by way of indication and do not limit the invention in any way. In the figures.

MORE DETAILED DESCRIPTION

Figure 1:
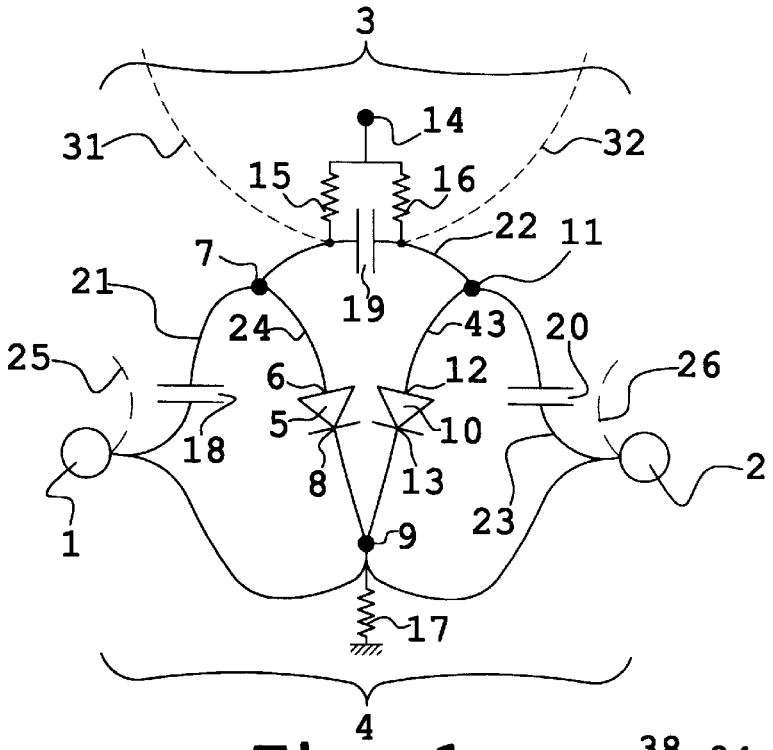
FIG. 1 is a functional representation of a high frequency circuit of the invention in a preferred variant having two PIN diodes.

FIG. 1 shows a variable phase-shift high-frequency circuit of the invention. The circuit has an input 1 for a high frequency signal. It also has an output 2 for said signal after it has been phase shifted. Between the input 1 and the input 2, there are provided two paths respectively referenced 3 and 4. The paths 3 and 4 are of different lengths. In one example, the lengths of the path 4 is equal to $3\lambda/4$ where $\lambda$ is the wavelength of the wave of the signal admitted to the input 1. In this same preferred example, the path 4 has a length of $2\lambda/4$. Nevertheless, these lengths are approximate, particularly since the circuit is usable over a wide frequency range. However, as explained below, the real limit on the passband of the circuit of the invention is associated with the fact that a wavelength difference itself becomes equal to the wavelength of a signal to be phase-shifted, or to a multiple thereof.

In the invention, the circuit essentially comprises a PIN type diode 5 connected in one example via its anode 6 to a first intermediate node 7 of the path 3 while its cathode 3 is connected to a second intermediate node 9 of the second path 4.

In an example, the propagation distance between the input 1 and the first intermediate node 4 is about $\lambda/4$, as is the distance between the input 1 and the second intermediate node 9. The cathode 6 is connected to the node 7 via a segment 24 of non-negligible length, close to $\lambda/4$ in an example. Because of the difference in length between the propagation paths 3 and 4, and/or because of the presence of the segment 24, the resistive impedance of the diode 8 transferred to the input 1 is different as seen on propagation path 3 from that seen on propagation path 4. Consequently, a signal reaching the input 1, for any given value of said impedance, will select one path rather than the other. This is the criterion actually used for adjusting the phase shifter of the invention. At the output 2, the greater signal will either be the direct signal resulting from propagation along the path 4, or else the delayed signal resulting from propagation along the longer path, e.g. 3. Depending on which signal is favored, the resulting signal will be more in phase with the direct signal or with the delayed signal. The desired phase shift is obtained in this way.

For reasons of input and output matching, the circuit is duplicated. Another diode 10 is connected between the first path and the second path between a third intermediate node 11 on said first path and the second intermediate node 9 on the second path 4. The intermediate node 7 is remote from the intermediate node 11. In an example, the distance between them is likewise about $\lambda/4$. In practice, the first path 3 is thus made up of three segments of length $\lambda/4$. The example shown indicates that the cathodes 6 and 12 of the diodes 5 and 10 are connected to the intermediate nodes 7 and 11. It is entirely possible to reverse each of the two diodes and to connect their anodes 8 and 13 to the intermediate nodes 7 and 11 instead of their cathodes 6 and 12. In which case their cathodes 6 and 12 would be connected to the intermediate node 9.

The circuit for biasing the diodes 5 and 10 comprises a generator (not shown) which applies a positive voltage, e.g. 3 volts, to a connection node 14 between two parallel resistors 15 and 16. The other ends of the resistors 15 and 16 are respectively connected to the intermediate nodes 7 and 11. The intermediate node 9 is also connected to ground via a resistor 17. To be able to make the diodes operate properly, the generator constituted by the voltage source and the resistors 15 and 17 is a current generator. To this end, the resistors 15 and 17 are of high resistance, e.g. 1 kΩ or 10 kΩ. Thereafter, by varying the values of one or both resistors, and/or the voltage applied to the node 14, it is possible to modify the more or less conductive state of the diodes 5 and 10. For example, if a conduction current in the diodes is low, then they are highly resistive. In contrast, if the current is higher, then they are less resistive.

In practice, the diodes 5 and 10 do not contribute only variation of the real portion of their impedance to the input 1 and to the output 2. They also contribute an imaginary portion of said impedance. Nevertheless, this imaginary portion presents the advantage of varying little or not at all with voltage. Consequently it is easy to compensate. Compensation can be achieved by the lengths of the connections, in particular the lengths of the connection connecting the cathode 6 to the intermediate node 7 and of the connection connecting the cathode 12 to the intermediate node 11. In this way, and for a frequency range of at least 10% of the high frequency signal admitted on the input 1, it is possible to estimate that the impedance transferred to the intermediate nodes 7 and 11 and also to the node 9 is an impedance that is purely resistive.

Although using a second diode 10 is not essential, a priori, for the purpose of obtaining the effects of the invention, it is nevertheless particularly advantageous because it produces two effects. Firstly the circuit becomes reversible. A signal can be introduced via its output. The same phase shift is then obtained at its input 1, then being used at its output, as is obtained when the same signal is applied to said input 1. That is why the circuit is, in addition, symmetrical in architecture.

Furthermore, to avoid transmitting a DC component through the circuit, it is necessary to place respective capacitors 18 to 20 in the first, second, and third segments 21 to 23 of the first path 3. These three segments, which in practice are each of equivalent length equal to $\lambda/4$, need to have real lengths that are, in fact, different. The lengths of the segments 21 to 23 depend on the presence of the capacitors 19 to 20 which cause phase to rotate.

The circuit described calls for two remarks. Firstly phase-shifting effects are obtained over a very wide frequency range. The range can be considerably greater than the above-mentioned 10%. What matters is that the two paths 3 and 4 are of different lengths and/or that the segment 24 provides a contribution that is different from the impedance of the diode at the input 1 (and also at the output 2). The connection 24 which connects the anode 6 to the first intermediate node 7 has a length of about $\lambda/4$, so the variations in impedance to which the diode 5 is subjected are not transferred identically in the first path 3 and in the second path 4. The segment 21 and the connection 24 together form a length of about λ/2, so there is even quadrature opposition in the transferred impedance. It is not really necessary for the path length difference to be about λ/4. Nevertheless, this difference determines the phase shift that can be obtained with this circuit. The further the path length difference from the length λ/4, the smaller the range of adjustment. Secondly, the symmetrical appearance presents numerous advantages in design and implementation.

The invention thus produces a phase shift with an impedance, namely the impedance of the PIN diodes transferred to the input 1, which impedance has an imaginary component that is small. It would be possible to use schottky type diodes instead of PIN diodes but schottky diodes produce intermodulation effects because their junction possesses fast minority carriers. Such a diode has impedance that varies at the same rate as the high frequency signal, in addition to the DC value as set by the bias.

Finally, the high frequency signal essentially does not propagate through the diodes 5 and 10, but only along the paths 3 and 4. If these paths 3 and 4 are made with characteristic impedances of about 50 ohms for the major part of the adjustment, then the impedance transferred to the intermediate node 7 by the segment 24 from the anode 6 is very different from 50 ohms, and as a result the segment 24 takes less of the signal to be propagated than does the segment 22.

Figure 2:
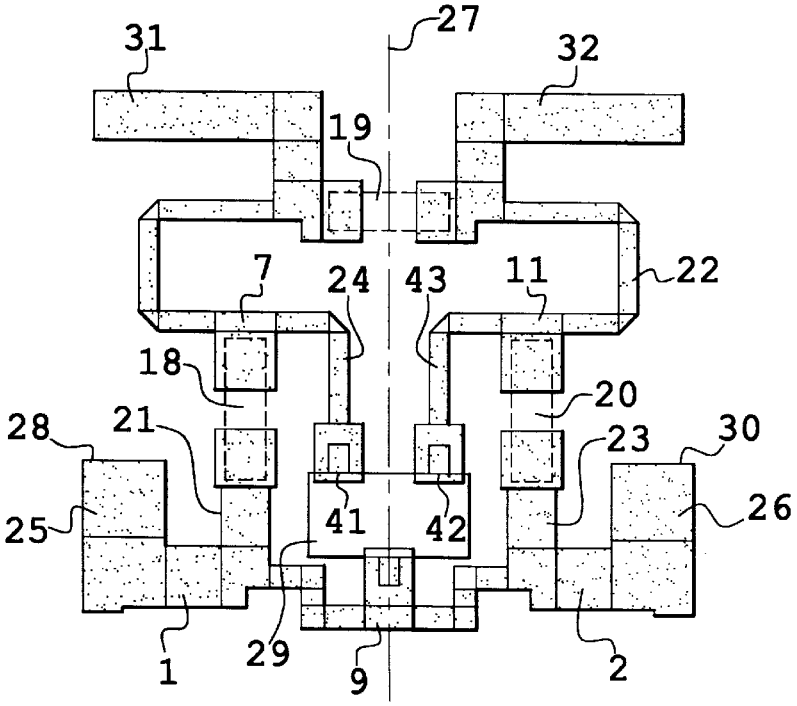
FIG. 2 is an enlarged view of the architecture of the connections made on a printed circuit that serves to provide the propagation paths.

FIG. 2 shows on a larger scale a preferred embodiment of the metallization of a printed circuit that can be used for constituting the paths 3 and 4 and the connections such as 24. In accordance with the above, the circuit of FIG. 2 is essentially symmetrical about an axis of symmetry 27. On one side, e.g. to the left, there can be seen the input 1 of the circuit in the form of a rectangular area of metallization. This input 1 is electrically connected to matching metallization 25 which transfers on the input 1 the impedance of an open circuit 28: the end of the metallization 25. Starting from the input 1, a first metallization connection leads to the intermediate node 7 by passing in series through a capacitor 18 represented solely by a space for receiving it. A segment 24 is made from the intermediate node 7 to a package 29 containing the diodes 5 and 10. In the layout of the circuit, the segment 21 and the segment 24 are substantially parallel to each other. The metallization of the segment 21 is wider than the metallization of the segment 24. These widths are determined by experiment and after simulation, and they correspond to the characteristic impedances to be implemented in the segments 21 and 24 respectively in order to achieve the desired result. The segment 22 is formed from the intermediate node 7 as two symmetrical crescents connected to the nodes 7 and 11 respectively. The two crescents are connected together via a capacitor 19 connected like the capacitor 18. The segment 23 is symmetrical to the segment 21. It leads to the output 2. Like the input 1, the output 2 has a matching element 26 likewise transferring an open circuit 30 on the output 2. For impedance-matching reasons on either side of the connection to the capacitor 19, two impedance-matching elements 31 and 32 are disposed facing each other and extending parallel to the crescents of the segment 22. The matching elements 25, 26, 31, and 32 are represented in FIG. 1 by dashed lines.

In practice, the capacitors 18 to 20 are surface-mount type capacitors making low cost manufacture possible. They are fitted to the printed circuit at the same time as the other components are fitted thereto.

Figure 3:
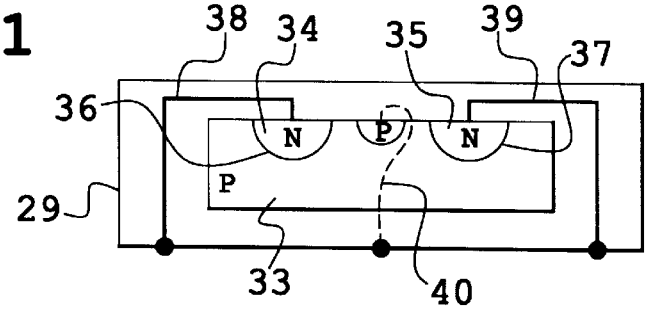
FIG. 3 is a diagrammatic section of a metal oxide semiconductor (MOS) type integrated circuit suitable for manufacturing PIN diodes to enable them to be mounted in SMC type packages.

FIG. 3 shows a preferred embodiment of the package 29 containing the two diodes 5 and 6. The diodes are made, for example, in a semiconductor substrate 33, which is of the P type in this example. These diodes are constituted by N type implants 34 and 35 in the P substrate with respective insulating layers 36 and 37 to constitute the PIN type diodes at the junctions between the P and N regions. The P and N regions of the semiconductor are connected to connection tabs in the bottom of the package 29. In one example, the package 29 is of the C115 or SOT 323 type. Connections 38, 39, and 40 which connect these regions of the semiconductor to the tabs of the package are connected respectively to one end 41 of the segment 24 and to one end 42 of a segment 43 that is symmetrical to the segment 24. The segments 24 and 43 are connected to the intermediate nodes 11 and 9 respectively.

The circuit can also be fully integrated on a monolithic semiconductor substrate. Under such circumstances, links proportional to λ/4 can be replaced by inductors and capacitors having the same effects. In such an embodiment, the entire circuit is in the form of a circuit having an input, an output, a control tab 14, and a tab for connecting the resistor 17 to ground. This tab may coincide with the package of the circuit.

What is claimed is:

1. A high frequency circuit of variable phase shift, the circuit comprising an input for a high frequency signal, two propagation paths for said signal each connected at one end of said input, a PIN diode having its terminals connected to first and second intermediate nodes on each of the two paths respectively, an output for the phase-shifted high frequency signal connected to the other ends of the two paths, a circuit for biasing the diode, and a second PIN diode, likewise biased, having its terminals connected to the first intermediate node on one path and to a third intermediate node on the other path, in parallel with the first diode.

2. A circuit according to claim 1, including a voltage generator connected by two parallel resistors to the anodes or to the cathodes of the PIN diodes, said resistors preferably being of high resistance.

3. A circuit according to claim 1, wherein the two diodes are contained in the same package, preferably being made by MOS technology on a common semiconductor substrate.

4. A circuit according to claim 1, having segments of length proportional to λ/4 between the intermediate nodes or between the intermediate nodes and the ends of the paths.

5. A circuit according to claim 1, wherein the PIN diode is contained in a surface-mount type package.

6. A circuit according to claim 1, including capacitors connected in series in the segments of a propagation path.

7. A circuit according to claim 1, including paths of different lengths, in particular a path of length 3λ/4 and a path of length 2λ/4.

8. A circuit according to claim 1, the circuit being of symmetrical architecture.

9. A circuit according to claim 1, including matching elements.

10. A circuit according to claim 1, the circuit being integrated on a monolithic semiconductor substrate.

11. A circuit, comprising:

an input for a first high frequency signal having a first phase;

a first propagation path and a second propagation path, on which the first high frequency signal is transmitted, wherein a respective first end of each of the first and second propagation paths is connected to the input;

a first PIN diode whose first terminal is connected to a first intermediate node on the first propagation path and whose second terminal is connected to a second intermediate node on the second propagation path;

a second PIN diode whose first terminal is connected, in parallel with the first PIN diode, to a third intermediate node on the first propagation path and whose second terminal is connected to the second intermediate node on the second propagation path;

an output for a second high frequency signal having a second phase that is different from the first phase of the first high frequency signal, wherein a respective second end of each of the first and second propagation paths is connected to the output; and a circuit for biasing the first PIN diode and the second PIN diode.

12. A circuit, comprising:

an input for a first high frequency signal having a first phase;

a first propagation path and a second propagation path, on which the first high frequency signal is transmitted, wherein a respective first end of each of the first and second propagation paths is connected to the input;

a PIN diode whose first terminal is connected to a first intermediate node on the first propagation path and whose second terminal is connected to a second intermediate node on the second propagation path;

an output for a second high frequency signal having a second phase that is different from the first phase of the first high frequency signal, wherein a respective second end of each of the first and second propagation paths is connected to the output;

a circuit for biasing the PIN diode; and segments between at least one of i) the first intermediate node and the second intermediate node; ii) the first intermediate node and the second intermediate node and the respective first end; and iii) the first intermediate node and the second intermediate node and the respective second end; wherein a length of the segments is proportional to $\lambda/4$.

* * * * *